United States Patent [19]

Raabe

[11] Patent Number: 4,834,359

[45] Date of Patent: May 30, 1989

[54] PALLETIZING APPARATUS FOR WEB STOCK AND THE LIKE

[75] Inventor: Erich Raabe, Augustdorf, Fed. Rep. of Germany

[73] Assignee: Raco-Maschinenfabrik GmbH & Co. KG, Augustdorf, Fed. Rep. of Germany

[21] Appl. No.: 67,618

[22] Filed: Jun. 26, 1987

[30] Foreign Application Priority Data

Nov. 3, 1986 [EP] European Pat. Off. ..... 86115189

[51] Int. Cl.[4] ..... B65H 29/46

[52] U.S. Cl. ..... 270/31; 493/410

[58] Field of Search ..... 270/30, 31; 493/410, 493/411, 412, 413, 414, 415

[56] References Cited

U.S. PATENT DOCUMENTS 4,708,331 11/1987 Etcheparre et al. ..... 270/31

FOREIGN PATENT DOCUMENTS 3422352 12/1985 Fed. Rep. of Germany ..... 270/31

937511 1/1961 United Kingdom ..... 270/31

*Primary Examiner*—Robert E. Garrett

*Assistant Examiner*—Therese M. Newholm

*Attorney, Agent, or Firm*—Lambscher, Presta & Laubscher

[57] ABSTRACT

A placing arrangement for palletizing an advancing material web of, for instance, unvulcanized rubber, includes a height-adjustable guiding device which includes a placing frame, a carriage mounted on the placing frame for displacement in opposite directions, and at least two driven placing rollers that are rotatably mounted on the carriage and bound an action gap. A centering device is mounted on the guiding means upwardly of the placing rollers. The centering device is operative for guiding the material web so as to constantly remain in its central disposition. The centering device includes two guiding rollers which are situated oppositely to one another and extend transversely of the placing rollers. The guiding rollers are pressed in their position of use against respective lateral edges of the material web, and they are simultaneously moved together and apart to the same extent. The guiding rollers are mounted on respective roller carriages which are moved together and apart by a pressurized cylinder unit which is connected to the roller carriages either directly or via a chain drive.

7 Claims, 4 Drawing Sheets

PALLETIZING APPARATUS FOR WEB STOCK AND THE LIKE

BACKGROUND OF THE INVENTION

The present invention relates to web guiding arrangements in general, and more particularly to an arrangement for palletizing an advancing material web, such as an unvulcanized rubber web.

There are already known various constructions of placing arrangements, among them such which are designed for the palletization of a material web, such as an unvulcanized rubber web. One known arrangement of the latter type includes a vertically adjustable guiding device which includes a guide or placing frame, a guide carriage mounted on the guide frame for alternate displacement in opposite directions, and at least two driven guide rollers that are rotatably mounted on the carriage to define a guide gap for receiving the web.

In the arrangement of this type, the continuous raw rubber web which emerges out of a rubber cooling installation is continuously or intermittently supplied through a feeding device into the guiding device, where it is engaged by the guide rollers and is placed onto a pallet or the like due to horizontal displacement of the guide rollers to and fro.

The raw rubber web is cut during its passage through the rubber cooling installation, with the exception of a small layer which is reminiscent of perforation, into longitudinal strips which have a width that corresponds to the requirements of the further treatment. Inasmuch as the individual strip webs are to be separated from each other during the further treatment, it is desirable that the material web be stacked in such a manner that the respective cut edges are situated substantially in the same position throughout the stack, inasmuch as this is the only way to achieve a smooth and uninterrupted withdrawal of the individual strip webs, which results in an improvement of the manufacturing operation and thus an economical operation. This, however, was not accomplished in the placing arrangement of the above type.

SUMMARY OF THE INVENTION

Accordingly, it is a general object of the present invention to avoid the disadvantages of the prior art.

More particularly, it is an object of the present invention to provide a guide or placing arrangement which does not possess the drawbacks of the known arrangements of this type.

Still another object of the present invention is to devise a placing arrangement of the type here under consideration which would render it possible, by using very simple means, to place the material web on a substrate in such a manner that it is always exactly centered and thus the cut edges are situated at the same position throughout the stack formed from the material web.

It is yet another object of the present invention to design the above arrangement in such a manner as to facilitate the withdrawal of the strip webs which follows the placing operation, and to make this withdrawal more economical than before.

A concomitant object of the present invention is so to construct the arrangement of the above type as to be relatively simple in construction, inexpensive to manufacture, easy to use, and yet reliable in operation.

In keeping with these objects and others which will become apparent hereafter, one feature of the present invention resides in a guide or placing arrangement for palletizing an advancing material web of, for instance, unvulcanized rubber, this arrangement comprising vertically-adjustable guiding means including a guide frame, a carriage mounted on the guide frame for displacement alternately in opposite directions, and at least two driven guide or placing rollers that are rotatably mounted on the carriage and define a guide gap for the web. This arrangement further includes centering means mounted on the guiding means upwardly of the guide rollers and operative for centering the material web so as to constantly remain in its central disposition.

It is assured by the construction of the guide arrangement as described so far that the disposition of the center of the material web which is to be transported by the placing rollers is always the same. Inasmuch as the disposition of the cutting edges of the severed strips is also aligned by a severing device provided in the rubber cooling installation that is arranged upstream of the placing arrangement with respect to the center of the material web, there is assured an exact palletization of the material web along the cut edges.

A particularly simple but effective feature of the present invention provides for the centering means to include two centering rollers which are situated oppositely to one another and extend transversely of the guide rollers, means for pressing the centering rollers in a position of use thereof against respective lateral edges of the material web, and means for simultaneously moving the centering rollers together and apart to the same extent. In addition to the absolutely secure centering of the middle of the material web by the centering device which is constructed in the above-mentioned manner, this construction also offers additional advantages. On the one hand, the manufacture of this arrangement is particularly economical yet, on the other hand, its reliability in operation is very high, inasmuch as the control of the central disposition of the material web occurs here exclusively by mechanical components which render it possible to achieve a disruption-free operation even under the extremely rough operating conditions which prevail during the treatment of rubber webs.

Advantageously, the pressing means presses the centering rollers against the lateral edges of the material web with the same pressure. It is particularly advantageous when the centering means includes at least two roller carriages which are movable in mutually opposite directions, and at least two centering rollers each rotatably mounted on one of the roller carriages. In this context, it is further advantageous when the centering means further includes a centering frame which is connected with the carriage of the guiding means, and when the centering roller carriages are guided for movement in the centering frame.

A particularly simple and otherwise advantageous construction of the centering means is obtained when one of the centering carriages has a lug, and when the centering means further includes a pressurized cylinder unit having one end connected to the lug and another end connected by a flange to the guide carriage. Then, it is advantageous for the centering means to further include an elongated flexible element, such as a chain, a cable or a rope, which is connected to the lug and to the other of the centering roller carriages. The centering means may further advantageously include reversing rollers rotatably mounted on the centering frame, and the elongated flexible element may then be trained about the reversing rollers. The elongated flexible element may include tensioning members, of which one is arranged at each of the centering roller carriages. Last but not least, it is advantageous when the centering rollers are pressed against the material web with a pressure which preferably amounts to 0.8 bar gauge.

BRIEF DESCRIPTION OF THE DRAWINGS

The present invention will be described below in more detail with reference to the accompanying drawings in which.

DETAILED DESCRIPTION OF THE PREFERRED EMBODIMENT

Figure 1:
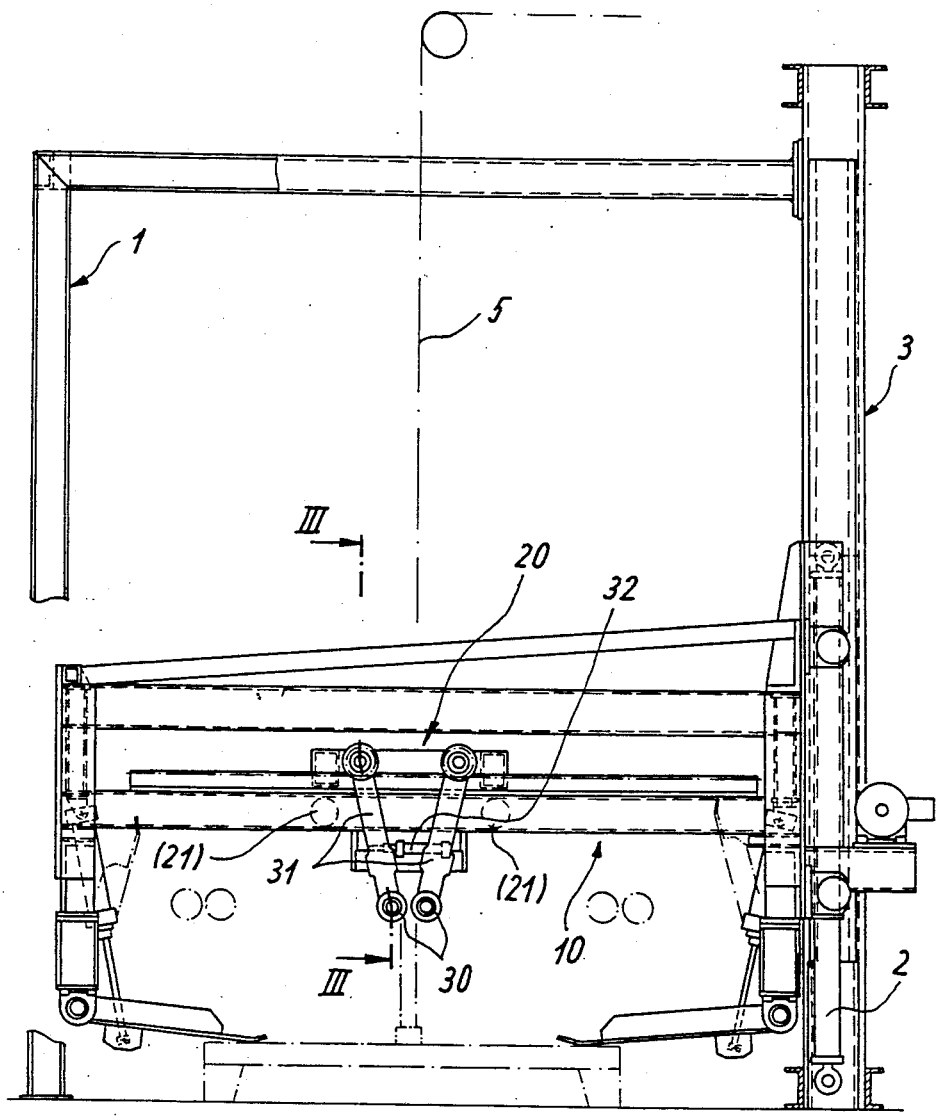
FIG. 1 is a side elevational view of a placing arrangement constructed in accordance with the present invention.
Figure 2:
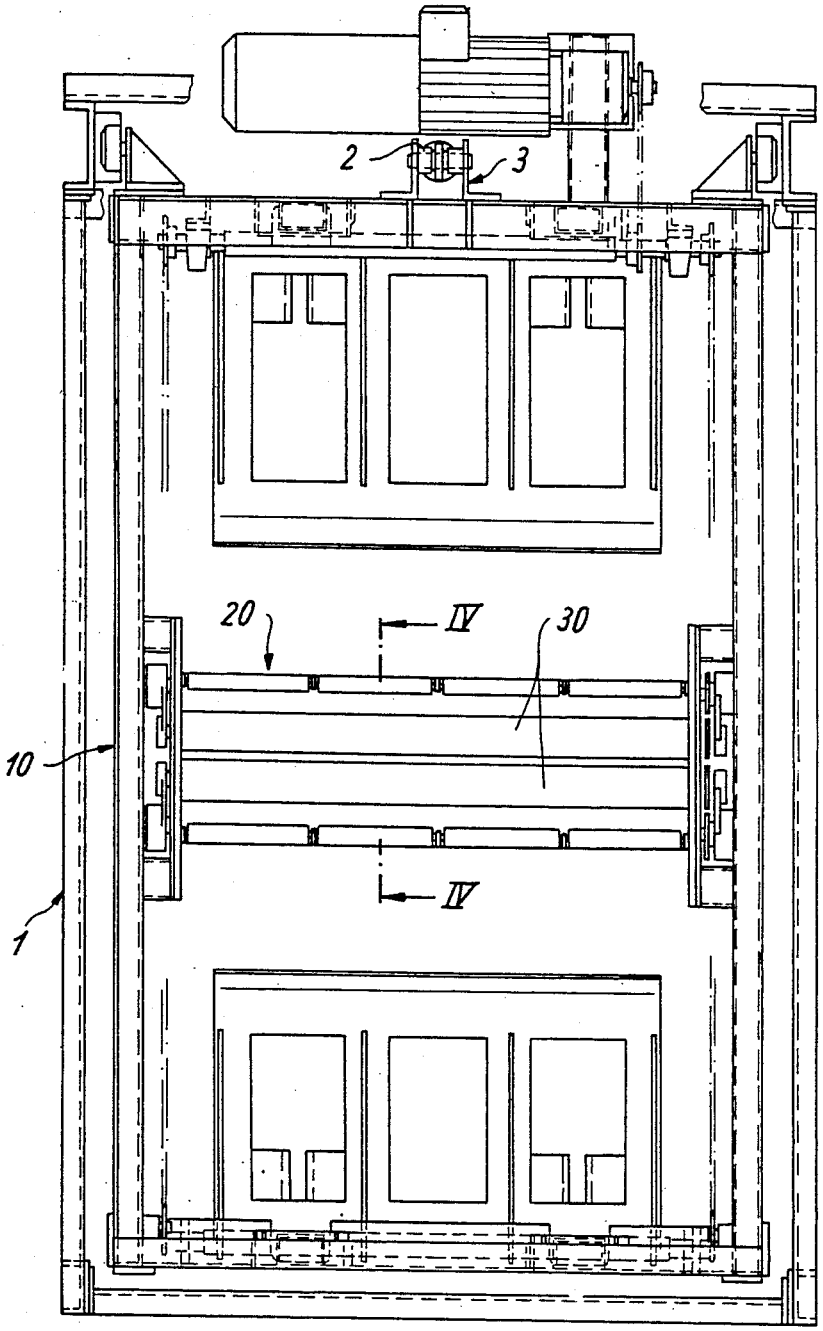
FIG. 2 is a top plan view of the placing arrangement of FIG. 1.

Referring now to the drawing in detail, and first to FIGS. 1 and 2 thereof, it may be seen that a web guide or placing arrangement depicted therein consists, as to its basic construction, of a main frame 1 which includes a rear vertical beam 3 that fixes the main frame 1 in position in a non-illustrated rubber cooling installation, and of a horizontal guide placing frame 10 which has one end that is guided on the beam 3 and which is vertically adjustable by means of a pressure cylinder unit 2.

A web guide carriage 20 which is provided with displacement rollers 21 is horizontally displaceable to and fro in the guide or placing frame 10. At the sides of the carriage 20 which extend transversely of the displacement direction, there are respectively pivotably mounted two pivot arms 31 at one of their ends, while the other ends of the pivot arms 31 are arranged at the respectively oppositely disposed rotatable horizontally spaced parallel guide or placing rollers 30 which can be driven. The pivot arms 31 are connected with one another by means of a pressure cylinder unit 32, so that the distance between the guide rollers 30 varies upon actuation of the pressure cylinder unit 32.

Figure 3:
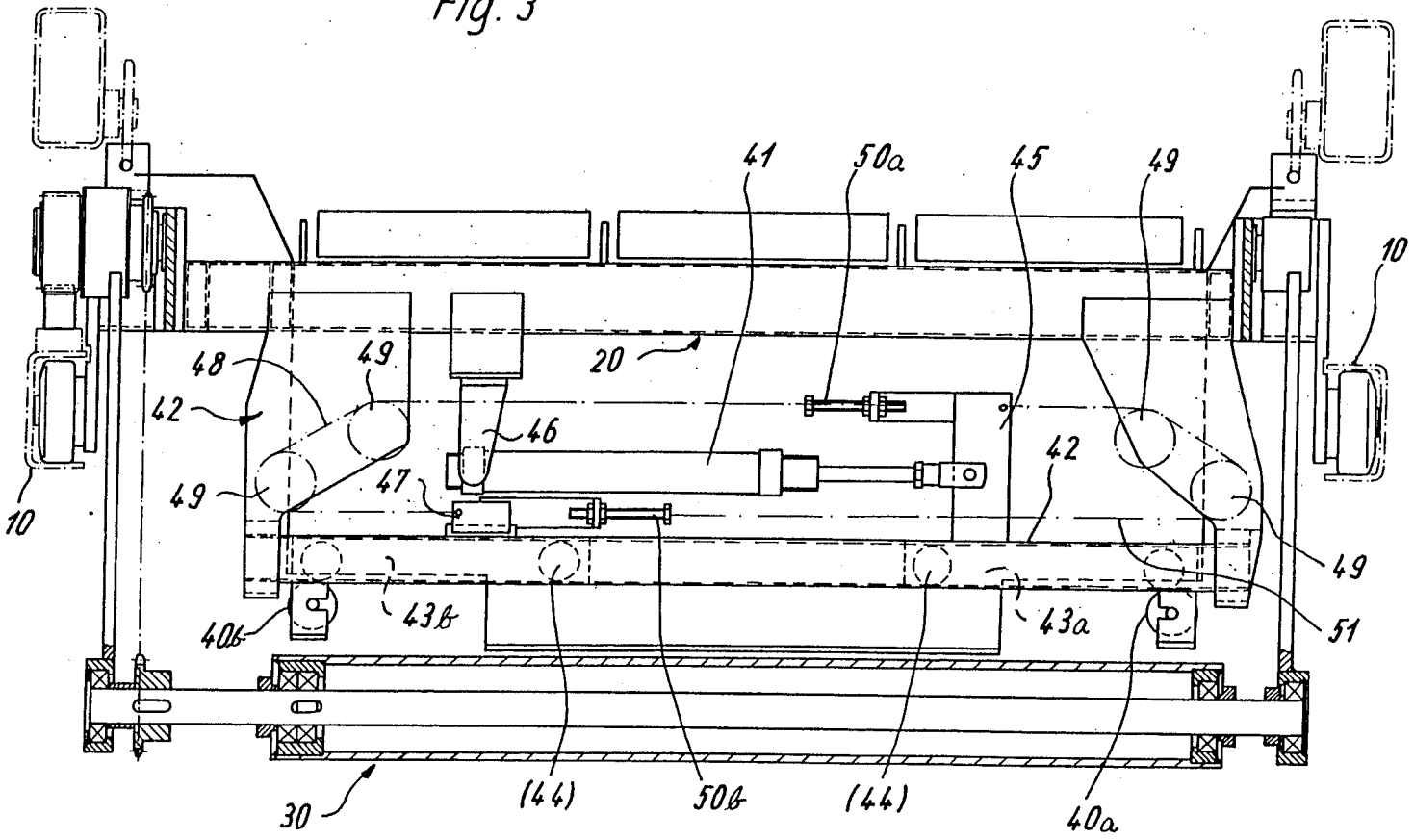
FIG. 3 is a sectional view of the placing arrangement, taken on line III—III of FIG. 1.
Figure 4:
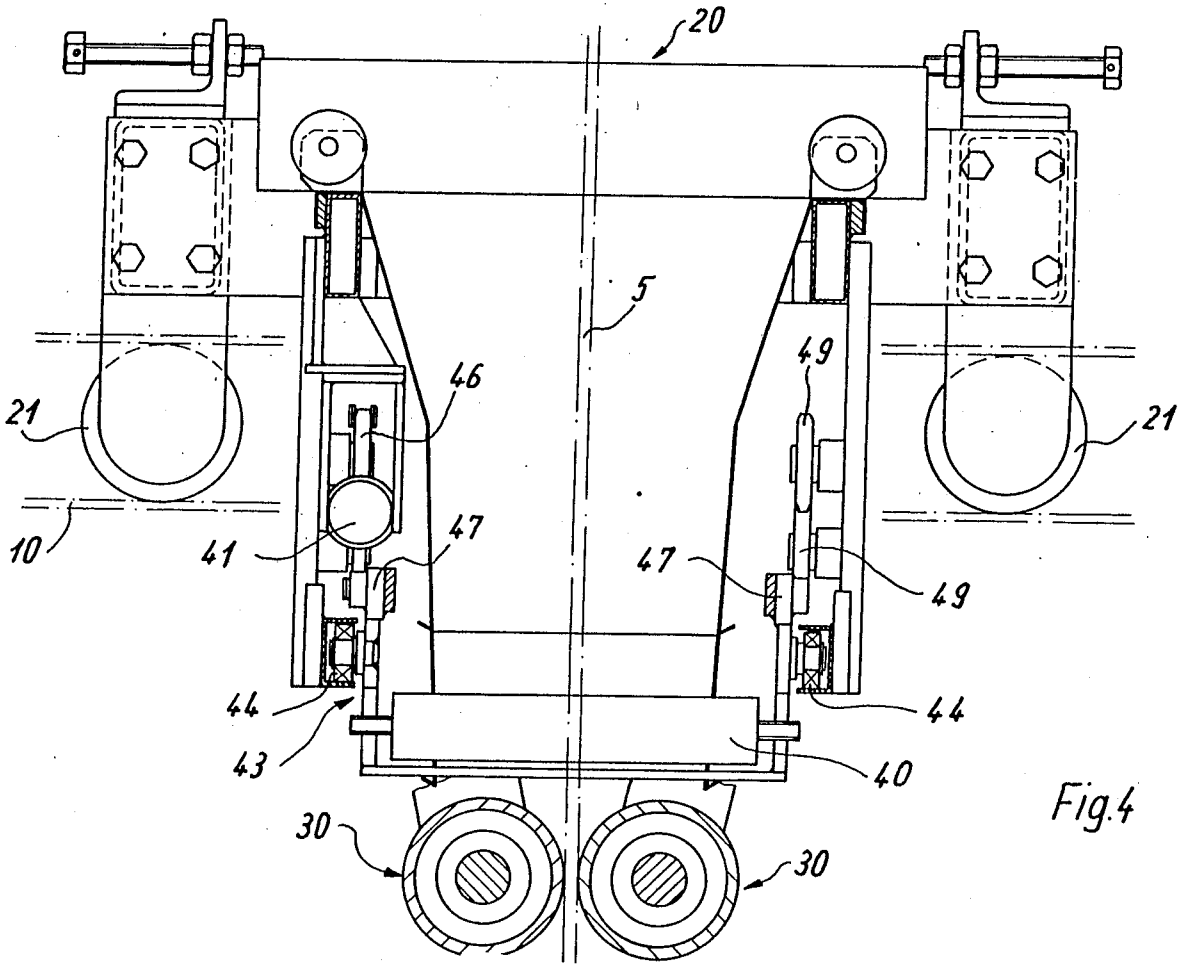
FIG. 4 is a sectional view of the placing arrangement, taken on line IV—IV of FIG. 2.

According to the present invention, a centering arrangement is provided upwardly of the guide rollers 30, this centering arrangement being operative for guiding the material web, in the example presented here a rubber web 5, so as to be maintained constant as to its central disposition relative to the guide rollers 30. As shown particularly in FIGS. 3 and 4, the centering arrangement includes two mutually oppositely located guiding centering rollers 40*a*, 40*b* which are arranged transversely of the guide rollers 30 and which, in the positions of use thereof, are pressed against the lateral edges of the rubber web 5 with the same pressure. Each of the centering rollers 40*a*, 40*b* is mounted on a centering roller carriage 43*a*, 43*b*, which includes rollers 44 that are guided in a centering frame 42 and which is displaceable transversely of the displacement direction of the rubber web 5. The centering frame 42 is mounted on the carriage 20 at a region between the guide rollers 30 and the carriage 20, so that the to and fro displacement of the carriage 20 and of the guide rollers 30 is also conducted by the centering frame 42.

The force for pressing of the centering rollers 40 against the rubber web 5 is exerted by a pressure cylinder unit 41 which is preferably constructed as a pressurized air cylinder unit. The pressure cylinder unit 41 includes a cylinder which is connected by means of a flange 46 with the guide carriage 20, and a piston which is rigidly connected, by means of a lug 45, with the centering roller carriage 43*a*. A chain tensioner 50*a* is also arranged at the lug 45, and a second chain tensioner 50*b* is arranged on an entraining member 47 which is connected to the other centering roller carriage 43*b*. At the region of each roller carriage 43*a*, 43*b*, there are mounted on the holding frame 42 two respective reversing wheels 49 which, in the exemplary embodiment presented here, are constructed as chain sprockets. A chain 48 is trained about the reversing wheels 49 which are remote from the piston of the pressure cylinder unit 41. One end of the chain 48 is connected with the entraining member 47, while the other end thereof is connected with the chain tensioner 50*a* which is mounted on the lug 45. Similarly, a second chain 51 is trained about the opposite reversing wheel 49. The chain 51 is connected, on the one hand, with the chain tensioner 50*b* which is mounted on the entraining member 47 and, on the other hand, with the lug 45. Instead of a chain, use of a rope or a cable, for example, is contemplated as well, in which event the reversing wheels would have to be configured correspondingly.

The reciprocating movements of the pressure cylinder unit 41 can be, for instance, coupled with the position of the guide rollers 30 with respect to each other. In accordance with this expedient, the pressure cylinder unit 41 is so switched, when the guide rollers 30 are in their spread-apart positions in which the rubber web 5 is being introduced, that the piston of the pressure cylinder unit 41 assumes its extended position. As a result, the centering carriage 43*a* which is directly coupled to this piston is also displaced into its outermost position, as is the oppositely situated centering carriage 43*b* due to the exercised chain pulling action which is exerted through the chain tensioner 50*a* which is connected to the lug 45 to the chain 48. Preferably, the pressure cylinder unit 41 is provided with a rapid deaeration valve which becomes operative during the spreading-apart operation, so that the two centering carriages 43*a*, 43*b* are correspondingly quickly displaced away from one another.

During the displacement of the guide rollers 30 toward each other, the pressure cylinder unit 41 is caused to collapse, so that the centering carriage 43*a* which is directly pulled by the piston of the pressure cylinder unit 41 is displaced in the direction toward the rubber web 5, while the displacement of the other centering carriage 43*b*, which is also conducted in direction toward the rubber web 5, is accomplished by the pulling action of the chain 51 which, as already mentioned before, is mounted on the lug 45, on the one hand, and on the chain tensioner 50*b* of the entraining member 47, on the other hand. What is characteristic during the displacement changes of the roller carriages 43 is their positional change which is simultaneous and occurs in mutually opposite direction. The respective lateral edges of the rubber web 5 form respective abutments for the centering rollers 40 during their displacement toward the rubber web 5. Herein, the centering rollers 40 are pressed against the lateral edges with a relatively low pressure, for example, with the pressure of 0.8 bar gauge, in order to avoid the creasing of the lateral edges in this manner.

Upon a change in the position or in the contour of the rubber web 5, the rubber web 5 is pressed by the rotatably mounted centering roller 40 which is associated with the changed advancement path or with the changed contour, in cooperation with the oppositely located centering roller 40, into a position which exactly corresponds to the predetermined central disposition.

While the present invention has been described and illustrated herein as embodied in a specific construction of a placing arrangement for rubber webs, it is not limited to the details of this particular construction, since various modifications and structural changes are possible and contemplated by the present invention. Thus, the scope of the present invention will be determined exclusively by the appended claims.

What is claimed is:

1. Apparatus for depositing a web (5) of sheet material, such as unvulcanized rubber, on a pallet or the like, comprising:

(a) main frame means arranged to transmit the web in a downwardly-oriented direction;

(b) guide means for alternately displacing the lower portion of the web relative to the main frame horizontally in opposite directions normal to the plane of the web, including:

(1) a horizontally arranged guide frame (10) connected for vertical movement relative to said main frame;

(2) a guide carriage (20) connected with said guide frame for horizontal displacement in alternate opposite directions normal to the web; and (3) a pair of horizontal parallel spaced guide rollers (30) mounted in spaced relation below said guide carriage, said guide rollers being orthogonally arranged relative to the direction of travel of said guide carriage and defining a gap for receiving the web; and (c) centering means for centering the web in a horizontal coplanar direction parallel with said guide rollers, including:

(1) a pair of horizontally-spaced centering carriages (**43*a*, 43*b***) connected with said guide carriage on opposite sides of the web for horizontal displacement parallel with said guide rollers;

(2) a pair of parallel horizontally spaced centering rollers (**40*a*, 40*b*) rotatably connected with said centering carriages and arranged on opposite sides of the web in orthogonal relation relative to said guide rollers; and (3) means including a piston and cylinder motor (41**) for alternately displacing said centering carriages in mutually opposite directions relative to said guide carriage toward operative and inoperative positions in which said centering rollers are in engagement with and are spaced from the longitudinal edges of the web, respectively, said motor being connected at opposite ends with said guide carriage and with at least one of said centering carriages, respectively.

2. Apparatus as defined in claim 1, and further including elongated flexible element means (48, 51) connecting said centering carriages for simultaneous movement relative to said guide carriage.

3. Apparatus as defined in claim 2, wherein said elongated flexible element means is a chain.

4. Apparatus as defined in claim 2, wherein said elongated flexible element means is a cable.

5. Apparatus as defined in claim 2, wherein said centering means further includes reversing rollers (**4*a***) rotatably mounted on said centering frame; and further wherein said elongated flexible element means is trained about said reversing rollers.

6. Apparatus as defined in claim 2, wherein said elongated flexible element means includes tensioning members, of which one is arranged at each of said centering carriages, respectively.

7. Apparatus as defined in claim 2, wherein said centering rollers are pressed against the longitudinal edges of the web with a pressure of about 0.8 bar gauge.

* * * * *